United States Patent [19]

Waide

[11] Patent Number: 4,545,336

[45] Date of Patent: Oct. 8, 1985

[54] ENGINE WITH ROLLER AND CAM DRIVE FROM PISTON TO OUTPUT SHAFT

[75] Inventor: William M. Waide, Pasadena, Calif.

[73] Assignee: BCDS Corporation, Temecula, Calif.

[21] Appl. No.: 656,682

[22] Filed: Oct. 1, 1984

[51] Int. Cl.[4] ..... F02B 75/22

[52] U.S. Cl. ..... 123/55 AA; 123/56 C

[58] Field of Search ..... 123/55 R, 55 A, 56 R, 123/56 C, 41.34, 55 AA, 55 SR

[56] References Cited

U.S. PATENT DOCUMENTS

| | | | |
|---|---|---|---|
| 1,355,451 | 10/1920 | Carpenter | 123/41.34 |
| 1,711,260 | 4/1929 | Caminez | 123/55 AA |
| 1,863,877 | 6/1932 | Rightenour | 123/55 SR |
| 1,931,401 | 10/1933 | Baisden | 123/55 AA |
| 3,572,209 | 3/1971 | Aldridge et al. | 123/55 AA |
| 3,584,610 | 6/1971 | Porter | 123/56 C |
| 3,604,402 | 9/1971 | Hatz | 123/56 C |
| 4,331,108 | 5/1982 | Collins | 123/56 C |

FOREIGN PATENT DOCUMENTS

| | | | |
|---|---|---|---|
| 1375892 | 9/1963 | France | 123/56 C |
| 0001892 | of 1910 | United Kingdom | 123/55 AA |
| 0402323 | 11/1933 | United Kingdom | 123/55 AA |

*Primary Examiner*—Craig R. Feinberg

*Attorney, Agent, or Firm*—William W. Haefliger

[57] ABSTRACT

An internal combustion engine includes (a) a pair of opposed cylinders and pistons reciprocating therein, (b) power and return rollers carried by each of the pistons to reciprocate therewith during piston travel, (c) a power output shaft having an integral and external driven cam located to be driven in rotation by the power rollers in response to power stroke travel of the pistons, the shaft having an axis of rotation, (d) a flange integral with the output shaft and having an internal cam track located to be engaged by the return rollers in response to return stroke travel of the pistons, (e) said power and return rollers having parallel axes of rotation, the return roller axes located closer to the shaft axis than the power roller axes.

5 Claims, 17 Drawing Figures

ENGINE WITH ROLLER AND CAM DRIVE FROM PISTON TO OUTPUT SHAFT

BACKGROUND OF THE INVENTION

This invention relates generally to internal combustion engines, and more particularly to light weight, compact engines suitable for example for powering lightweight (ultralight) aircraft, outbound motor boats, stationary power plants, automobiles, motorcyles, etc. The engine design is capable of utilizing standard four-stroke operation in conventional or diesel applications.

There is a need for engines of this type, where extreme compactness and light weight are at a premium; at the same time, maximum power output is desired. No prior engine of which I am aware posseses the highly advantageous features of construction modes of operation and beneficial results characterized by the engine describes herein, and also the lightweight, compact design embodied therein.

SUMMARY OF THE INVENTION

It is a major object of the invention to provide an improved engine having the above advantages and features of construction.

Basically, the engine is characterized by:

(a) one pair, at least, of opposed cylinders and pistons reciprocating therein, (b) power and return rollers carried by each of the pistons to reciprocate therewith during piston travel, (c) a power output shaft having an integral and external driven cam located to be driven in rotation by the power rollers in response to power stroke travel of the pistons, the shaft having an axis of rotation, (d) a flange integral with the output shaft and having an internal cam track located to be engaged by the return rollers in response to return stroke travel of the pistons, (e) the power and return rollers having parallel axes of rotation, the return roller axes located closer to the shaft axis than the power roller axes.

As will appear, the four stroke engine may typically include a cross head slider and a lateral guide roller also carried by each of the pistons, and guide structure associated with each cylinder for guiding reciprocating movement of said slider and guide roller. For piston strokes produce on revolution of the output shaft. Also, the engine may typically include a mounting shaft associated with each piston, and mounting a power roller, a return roller, a slider and a guide roller. For balance, the power roller and guide roller are located between the slider and return roller, the power roller located between the slider and the guide roller. Further, the mounting shaft typically has a first section carrying the slider, power roller and guide roller, and a second section carrying the return roller, the power roller axis defined by the first section and the return roller axis defined by the second section.

In addition, there typically are needle bearings via which said power, guide and return rollers are carried on the mounting shaft; to feed lubricant to the needle bearings, and therebeing a fixed casing having a port via which pressurized lubricant is delivered to the passages as the latter momentarily communicate with said port during piston reciprocation. For compactness, the power output shaft may typically have an I-shaped cross-section normal to the output shaft axis at a location readially inwardly of the guide roller. In this regard, the minimum thickness dimension of said I-shaped cross section is approached by the guide roller and is less than the minimum cross-sectional thickness of the power cam.

These and other objects and advantages of the invention, as well as the details of an illustrative embodiment, will be more fully understood from the following specification and drawings, in which:

DRAWING DESCRIPTION

DETAILED DESCRIPTION

Figure 1:
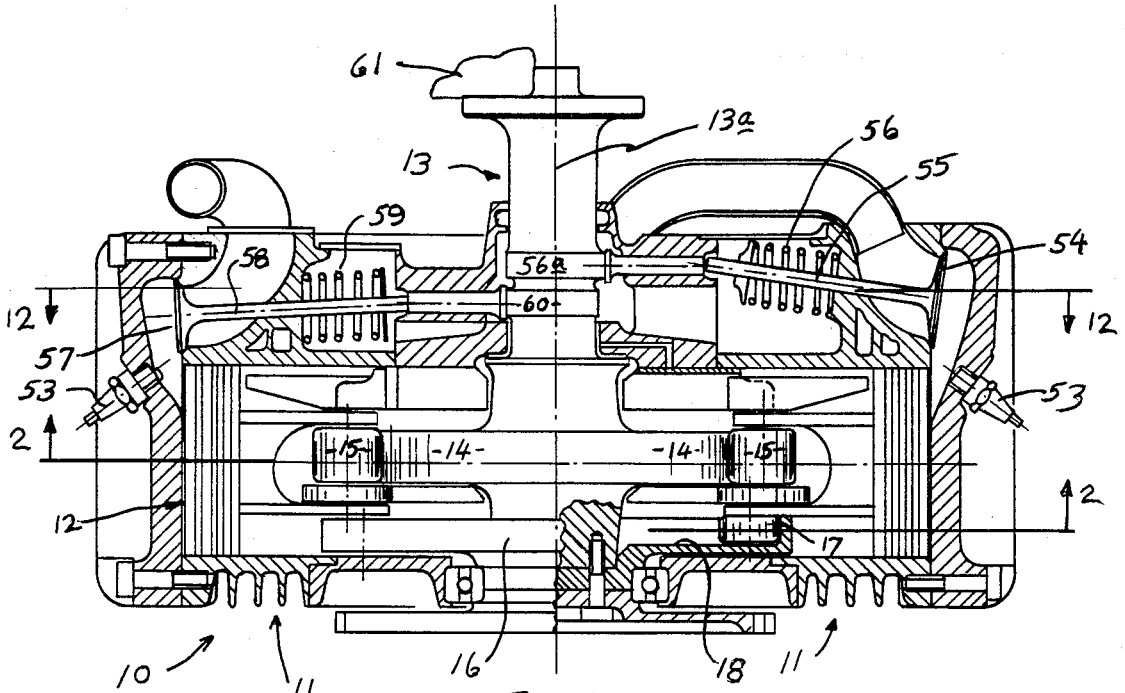
FIG. 1 is a sectional plan view of an engine incorporating my invention, the piston shown at top dead center.
Figure 2:
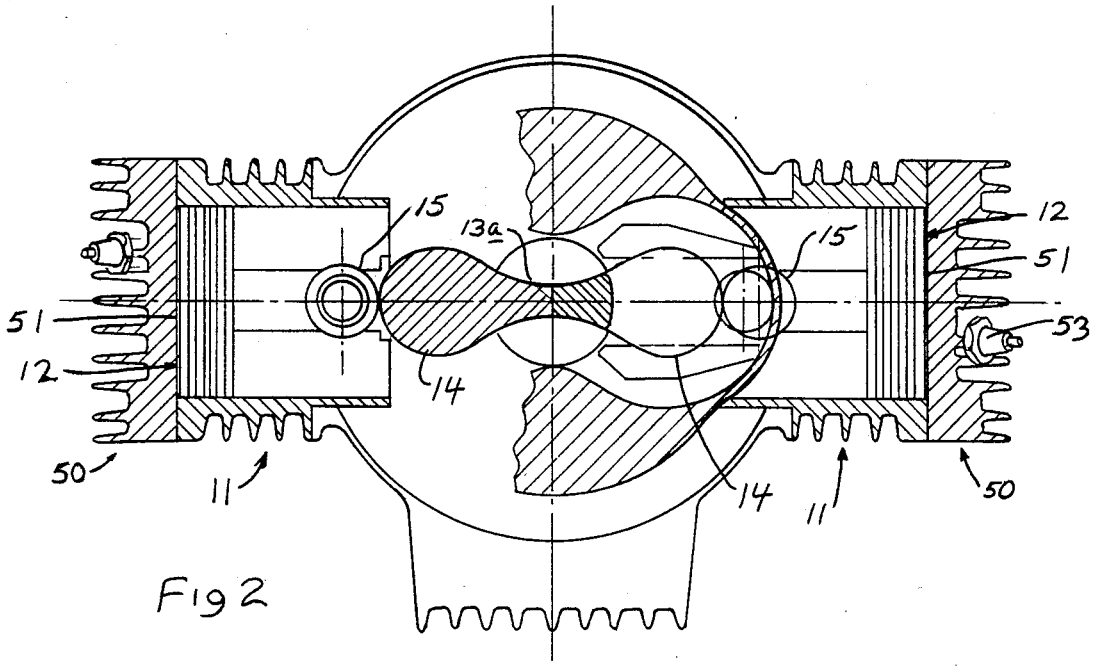
FIG. 2 is a sectional end view taken on lines 2—2 of FIG. 1.
Figure 3:
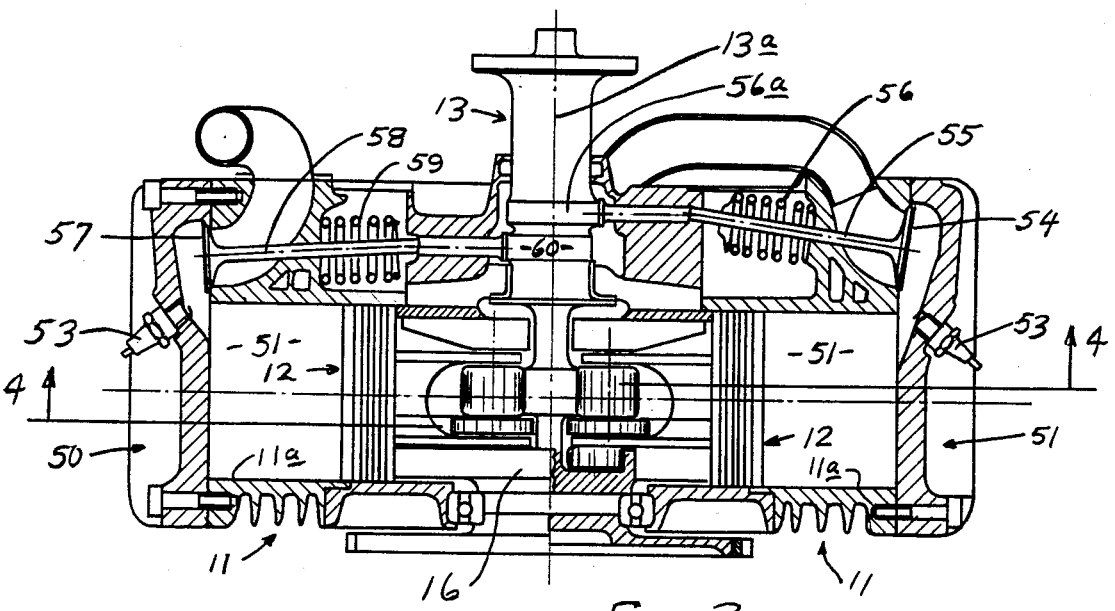
FIG. 3 is a view like FIG. 1 showing the piston at bottom dead center.
Figure 4:
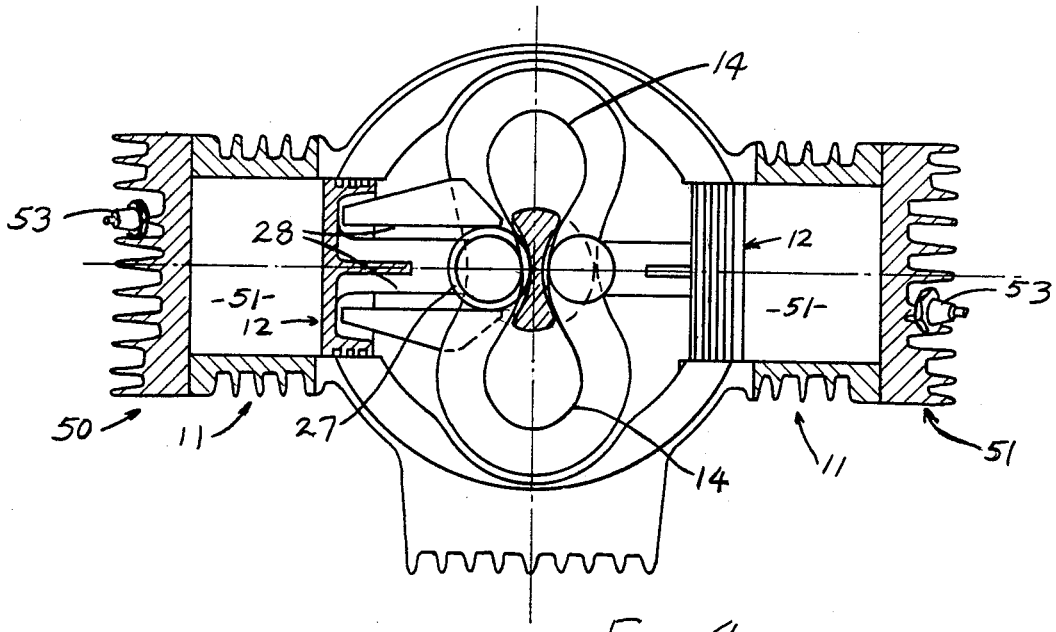
FIG. 4 is a sectional end view taken on lines 4—4 of FIG. 3.

The internal combustion engine 10 shown in the drawings includes a pair of opposed cylinders 11 and pistons 12 reciprocating in bores 11*a* therein. A power output shaft 13 rotates about axis 13*a*, extending generally perpendicularly to the axes of piston reciprocation. Shaft 13 has an integral and external cam as defined by two lobes 14 located to be driven in rotation by two power rollers 15 respectively carried by the pistons, in response to power stroke travel by the pistons toward axis 13*a*.

A circular flange 16 is integral with the output shaft, and has an internal cam track 16*a* located to be engaged by two return rollers 17 respectively carried by the pistons, in response to travel by the pistons away from axis 13*a*. As shown, the return rollers fit within a cavity or recess 18 formed in the side of flange 16, for compactness. Track 16*a* also has two lobe shafts.

A mounting shaft 19 is associated with each piston and mounts the associated power roller 15 and return roller 17, as shown. In particular, the axis 17*a* of rotation of return roller 17 about the shaft 19 is parallel to but offset closer to shaft axis 13*a* than the axis 15*a* of rotation of power roller 15 about shaft 19. This is facilitated by construction of shaft 19 to have two parallel sections 19*a* and 19*b*, interconnected by offset 19*c*. See FIG. 7. This construction also enables location of piston 12 closer to shaft axis 13*a*. Note in FIGS. 7 and 8 that the surface of the power roller 15 closest to the shaft axis engages the driven cam, as at 20, and the surface of the return roller 17 furthest from the axis 13*a* engages the cam track 16*a*, at 21.

Figure 5:
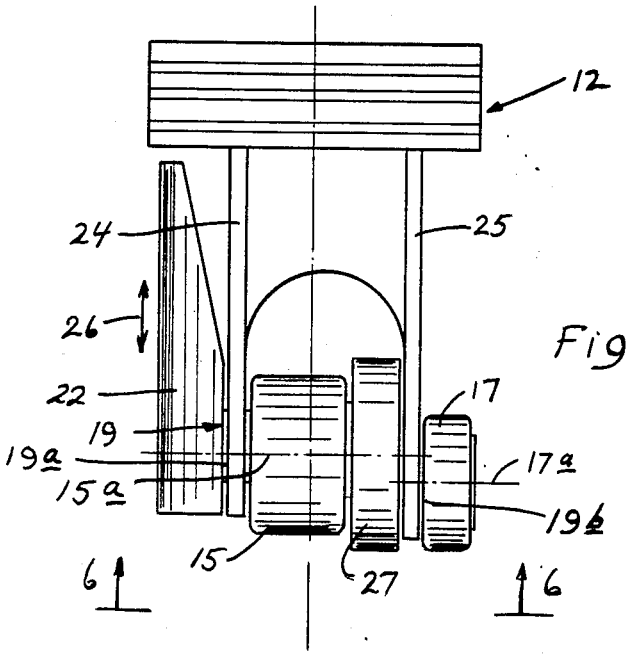
FIG. 5 is an elevational view of a complete piston assembly.
Figure 6:
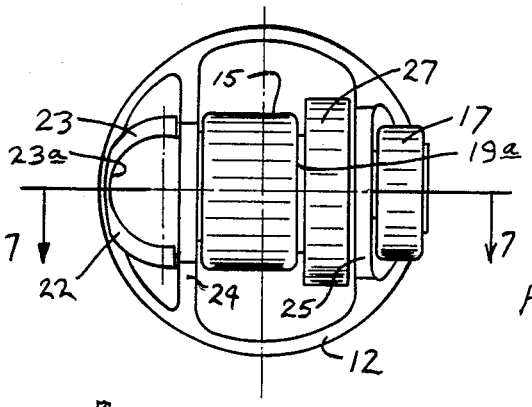
FIG. 6 is a bottom view taken on lines 6—6 of FIG. 5.

The first section 19*a* of the mounting shaft also carries a radially elongated cross head slider 22, for guided travel adjacent radially extending guide surface 23*a* which is arcuate in cross section (see FIG. 6). Surface 23*a* is defined by a radially extending guide 23 integral with the engine body or cylinder 11. Slider 22 is located at one end of the shaft section 19*a*, at the outer side of the piston strut 24. Return roller 17 is located at the end of shaft section 19*b*, at the outer side of piston strut 25. Struts 24 and 25 carry the mounting shaft for reciprocating travel in the direction indicated by arrows 26 in FIG. 5. Power roller 15 and a guide roller 27 are carried between struts 24 and 25, for rotation about the shaft section 19*a*, as shown. Lateral guide roller 27 rotates independently of roller 15, and between two fixed guides 28, which extend in directions 26 and which may be integral with the cylinder 11. As a result, optimum balance is achieved. See FIG. 6 showing elements 15, 17 23 and 27 located in balanced relation.

Figure 7:
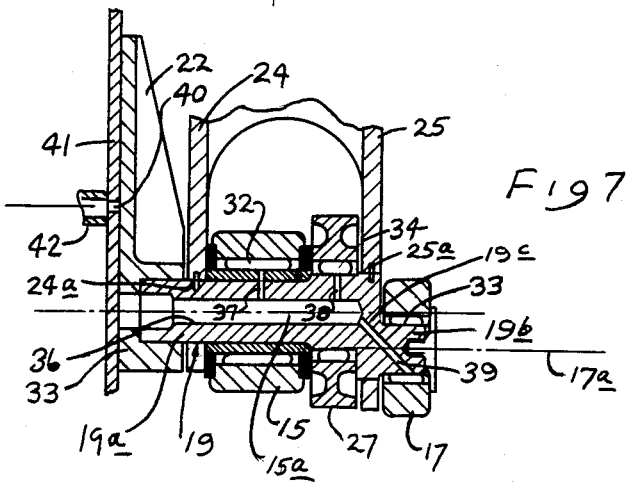
FIG. 7 is a section taken on lines 7—7 of FIG. 6.
Figure 8:
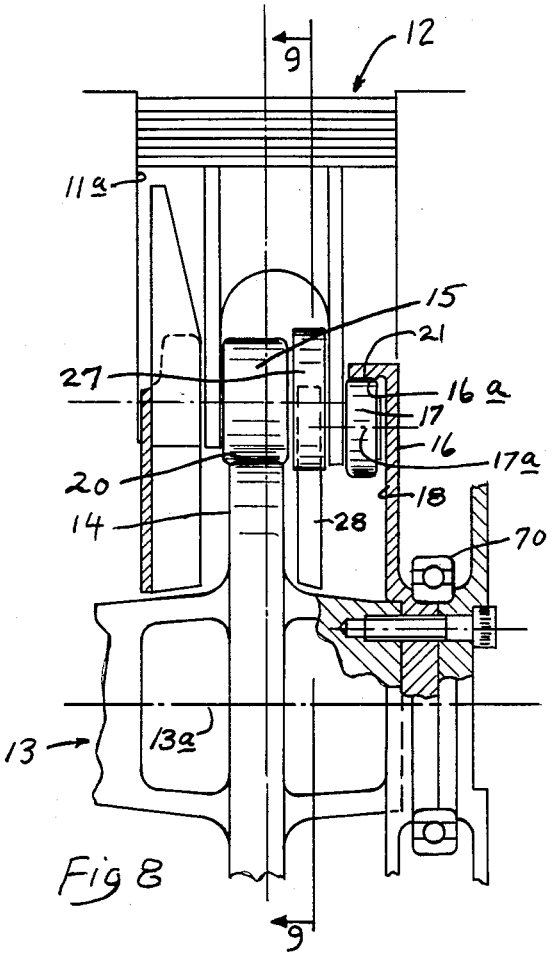
FIG. 8 is an enlarged view, partly in section, showing the piston and cam assembly in operating relation at top dead center.
Figure 9:
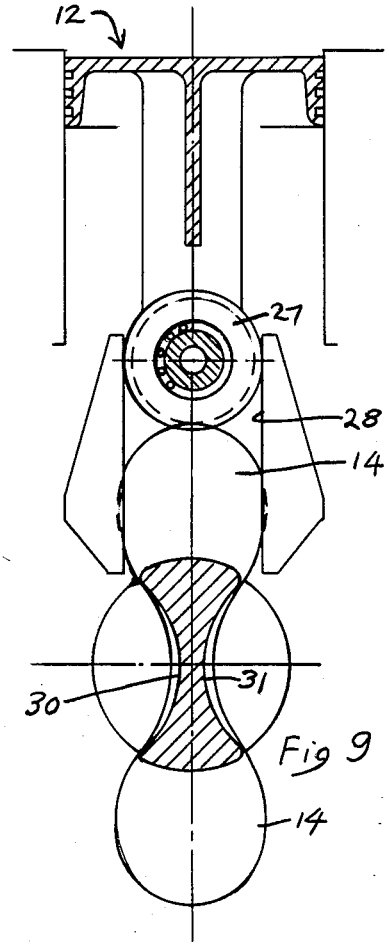
FIG. 9 is a sectional end view on lines 9—9 of FIG. 8.

FIG. 7 shows the fixed (as for example pinned) attachment of the mounting shaft to the two struts, at 24*a* and 25*a*. Also, needle bearing sets 32, 33, and 34 support roller 15, 17 and 27 for rotation on the mounting shaft.

Figure 10:
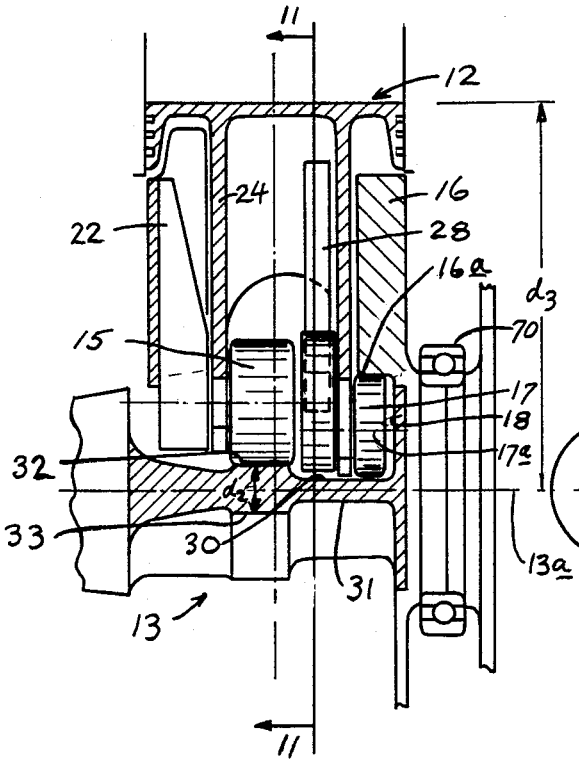
FIG. 10 is a view like FIG. 8, showing the elements at bottom dead center.
Figure 11:
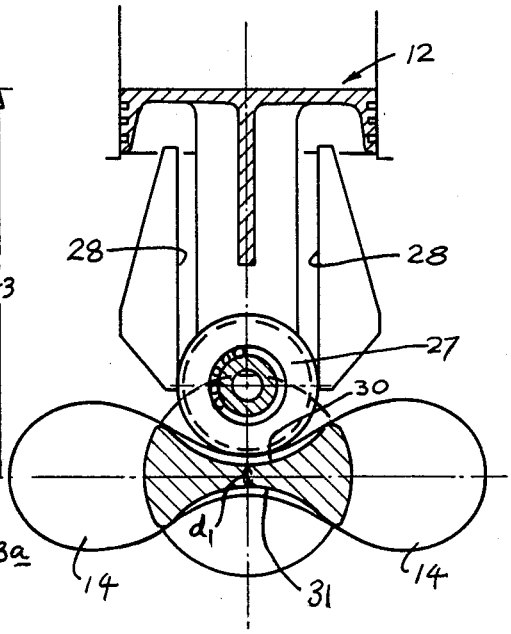
FIG. 11 is a sectional end view on lines 11—11 of FIG. 10.
Figure 12:
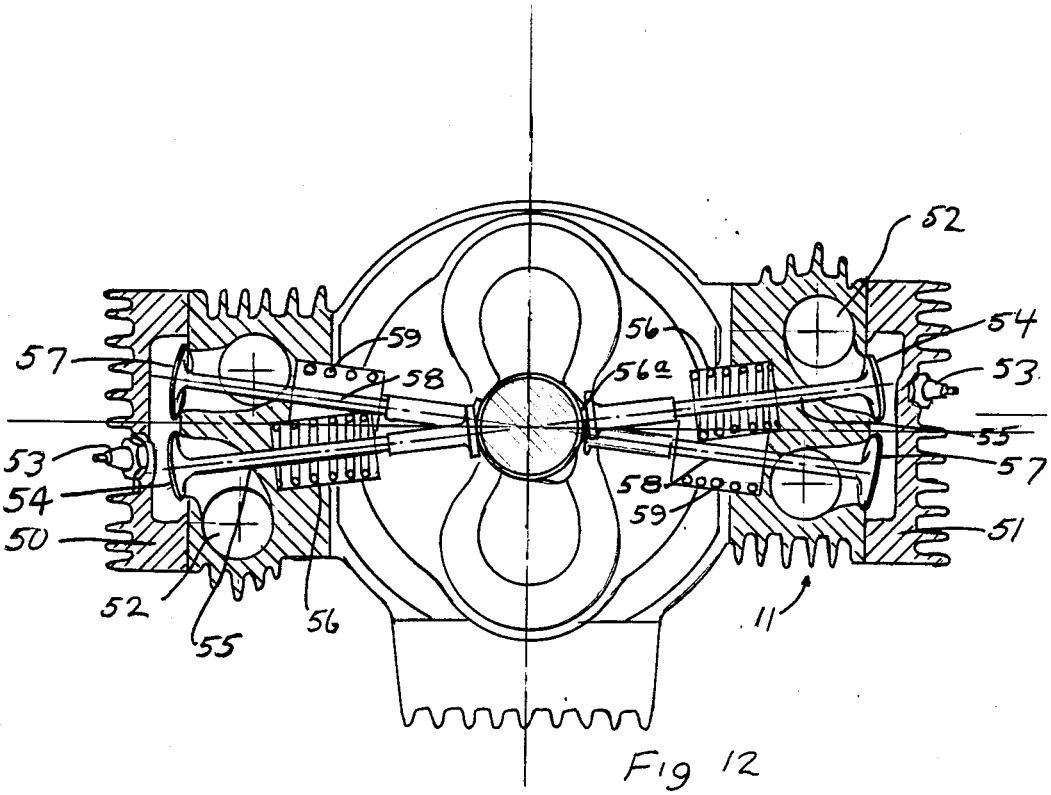
FIG. 12 is a sectional end view through lines 12—12 of FIG. 1, showing inlet and exhaust valve operation.
Figure 13:
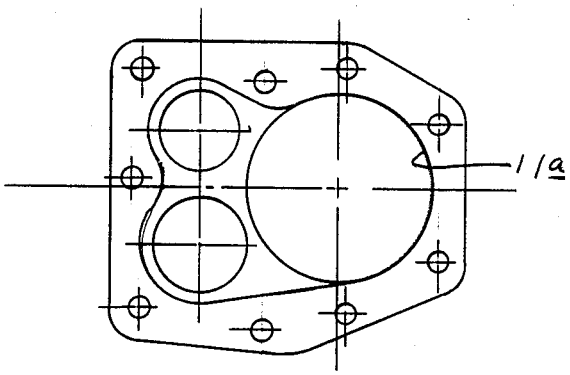
FIG. 13 is a view on lines 13—13 of FIG. 12.

Note in FIGS. 10 and 11 that the power output shaft is cut-away at 30 and 31, to have an I-shaped cross section of thickness $d_1$ whereby the rollers 17 and 27 may approach close to axis 13*a* and in the cut-aways, at bottom dead center position of the piston. Power rollers 15 at that time engage the power cam at locations 32 and 33, having spacing $d_2$, where $d_2 > d_1$. This also facilitates compactness, since the piston may approach close to the axis 13*a* (see dimension $d_3$). Also bending strength is not compromised.

Turning to FIG. 7, passages 36–39 in mounting shaft sections 19*a*, 19*b* and 19*c* feed pressurized lubricant to the needle bearings, from an oil port 40 in casing 41 (see lubricant supply duct 42). In this regard, as slider 23 travels back and forth, passage 36 in the slider momentarily registers with port 40, to receive a metered amount of lubricant.

Finally, in FIGS. 1–4, 12 and 13, the engine also includes cylinder heads 50 defining combustible mixture compression chambers 51; mixture inlet ducts 52; spark plugs 53; mixture inlet valves 54 on push rods 55; springs 56 urging the rods 55 towards cam 56*a* on shaft 13; exhaust valves 57 on push rods 58, the latter urged by springs 59 toward cam 60 on shaft 13. A propeller 61 may be mounted on shaft 13, as shown.

Figure 14:
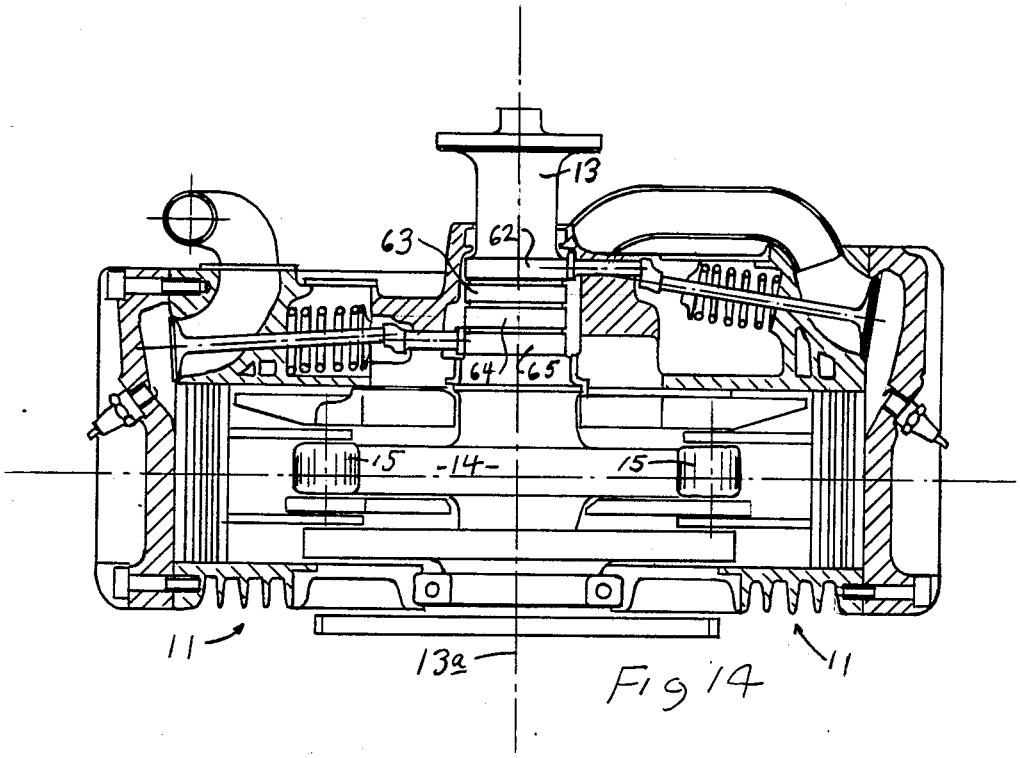
FIG. 14 is a view like FIG. 1, but showing a four cam modification.

FIG. 14 shows four cams 62–65 on a shaft 13, for operating inlet and exhaust push rods in the event of a staggered firing order, i.e. one cam set dedicated to odd numbered cylinders, and another cam set to even numbered cylinders. Cams 62 and 63 control one cylinder, and cams 64 and 65 control a second cylinder. Shaft bearings appear at 70 in FIGS. 8 and 10.

Figure 15:
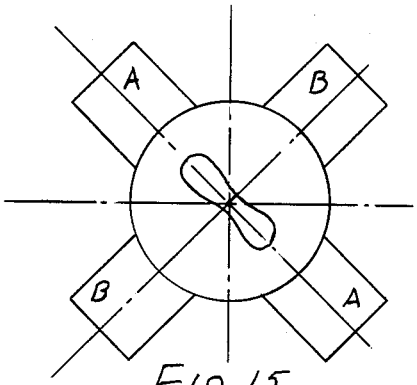
FIGS. 15 through 17 are schematics showing multiple cylinder arrangements.
Figure 16:
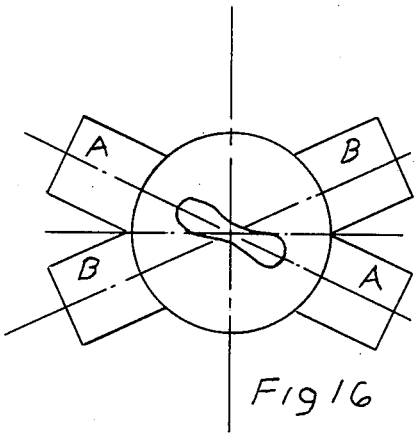
Figure 17:
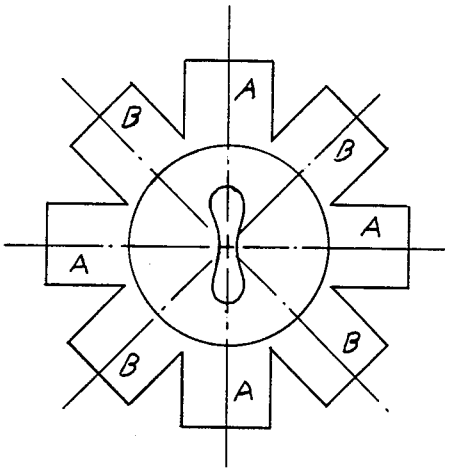

FIG. 15 is a schematic showing the cylinder arrangement about the shaft axis, for the FIG. 14 engine; FIG. 16 is like FIG. 15, but showing a modified cylinder arrangement; and FIG. 17 is a view showing an eight cylinder arrangement.

I claim:

1. In an internal combustion engine, the combination comprising (a) a pair of opposed cylinders and pistons reciprocating therein, (b) power and return rollers carried by each of the pistons to reciprocate therewith during piston travel, (c) a power output shaft having an integral and external driven cam located to be driven in rotation by contact only with the power rollers in response to power stroke travel of the pistons, the shaft having an axis of rotation, (d) a flange integral with the output shaft and having an internal cam track located to be engaged by the return rollers in response to return stroke travel of the pistons, (e) said power and return rollers having parallel axes of rotation, the return roller axes located closer to the shaft axis than the power roller axes, (f) there being a cross head slider and a lateral guide roller also carried by each of the pistons, and guide structure means associated with each cylinder for guiding reciprocating movement of said respective slider and guide roller to contain any lateral movement, (g) and including a continuous mounting shaft associated with each piston, and mounting each said power roller, each said return roller, each said slider and guide roller, said power roller and guide roller of each piston being located between said slider and return roller of each piston, the power roller located between the slider and guide roller of each piston, said mounting shaft having a first section carrying its respective said slider, power roller and guide roller, and a second section carrying its respective said return roller, the respective power roller axis being coaxial with said first section and the respective return roller axis being coaxial with said second section, said respective axes being parallel and spaced apart.

2. The combination of claim 1 wherein the surface of each power roller closest to the shaft axis engages the driven cam, and the surface of each return roller furthest from the shaft axis engages the internal cam track.

3. The combination of claim 1 wherein there are needle bearings via which said power, guide and return rollers are carried on the mounting shaft, there being passages in the mounting shaft to feed lubricant to said needle bearings, and therebeing a fixed casing having a port therein via which pressurized lubricant is delivered to said passage means as the latter momentarily communicates with said port during piston reciprocation.

4. The combination of claim 1 wherein the power output shaft has an I-shaped cross section normal to the output shaft axis at a location radially inwardly of each guide roller.

5. The combination of claim 4 wherein the minimum thickness dimension of said I-shaped cross section is approached by each guide roller and is less than the minimum cross-sectional thickness of the power cam.

* * * * *